United States Patent [19]

Kitagawa

[11] Patent Number: 4,876,935

[45] Date of Patent: Oct. 31, 1989

[54] ELECTRONIC MUSICAL INSTRUMENT

[75] Inventor: Hiroshi Kitagawa, Shizuoka, Japan

[73] Assignee: Kabushiki Kaisha Kawai Gakki Seisakusho, Hamamatsu, Japan

[21] Appl. No.: 102,410

[22] Filed: Sep. 29, 1987

[30] Foreign Application Priority Data

Oct. 4, 1986 [JP] Japan ..... 61-236864

[51] Int. Cl.[4] ..... G10H 1/02

[52] U.S. Cl. ..... 84/627; 84/633

[58] Field of Search ..... 84/1.01, 1.13, 1.26, 84/1.27; 381/29-35, 72, 47, 106; 358/138; 333/14

[56] References Cited

U.S. PATENT DOCUMENTS 4,123,711 10/1978 Chow ..... 333/14 X
4,162,462 7/1979 Endoh et al. ..... 333/14
4,353,035 10/1982 Schröder ..... 381/106 X
4,414,878 11/1983 Mitarai et al. ..... 84/1.26
4,433,434 2/1984 Mozer ..... 381/30
4,437,377 3/1984 Mitarai et al. ..... 84/1.01 X
4,507,791 3/1985 Gundry ..... 381/106 X
4,627,094 12/1986 Scholz ..... 333/14 X
4,642,583 2/1987 Fucito et al. ..... 333/14

*Primary Examiner*—A. T. Grimley
*Assistant Examiner*—Matthew S. Smith
*Attorney, Agent, or Firm*—McGlew and Tuttle

[57] ABSTRACT

This eliminates the possibility of the generation of quantizing noise in a small amplitude portion of the waveform when it is compressed to an 8-bit quantized form. The present invention is effective when a percussive or like musical tone, provided in the form of a 16-bit quantized digital form is compressed to the 8-bit quantized form.

4 Claims, 2 Drawing Sheets

ELECTRONIC MUSICAL INSTRUMENT

BACKGROUND OF THE INVENTION

1. Field of the Invention

The present invention relates to an electronic musical instrument which is adapted so that the compression of a harpsichord, percussive, or similar musical tone, provided in digital form, does not involve the generation of quantizing noise in its small amplitude portion.

2. Description of the Prior Art

A variety of systems have been proposed for reproducing complicated waveforms of natural musical tones by means of an electronic musical instrument. Among them there is a method which stores an A-D converted waveform as it is and reads it out for reproduction of a musical tone. Usually, a 12 to 16 bit quantization is needed for preventing the generation of quantizing noise in the A-D conversion of a natural musical tone. On the other hand, the quantized musical tone is stored in a ROM of an LSI in an 8-bit unit; accordingly, a musical tone expressed by, for example, 16 bits must be compressed to an 8-bit form. However, if the musical tone is compressed as it is, quantizing noise is generated markedly in its small amplitude portion in particular. To avoid this, various data compression methods have been proposed, but they mostly involve complicated circuit structures and are not suitable for fabrication as an LSI.

FIG. 1A shows an example of the waveform of a percussive sound. For example, where it is represented by 8-bit precision, the attenuated portion of the waveform assumes an amplitude of low-order 2 to 3 bits at most, and accordingly the bit precision of the waveform amplitude lowers. That is, even if the absolute quantization precision is 8-bit, the bit precision decreases at the rising and falling portions of the waveform relative to its amplitude, by which a bit change occurs in a large ratio, producing quantizing noise. Incidentally, the human hearing becomes sensitive as the attenuation proceeds. In order to retain the quantizing noise within the allowed limit in terms of the human hearing, quantization with 16 bits or so is needed. However, when a musical waveform quantized by 16 bits is compressed to an 8-bit form for storage in the 8-bit ROM, the quantizing noise will naturally become noticeable as referred to above.

To solve this problem, according to the present invention, when the musical waveform is compressed to the 8-bit form for storage in the ROM, its amplitude is expanded, in accordance with an envelope waveform to be appended later, to such an extent that quantizing noise will not become noticeable in the attenuated waveform. This amplitude-expanded waveform is compressed to its initial form later when it is appended with the envelope waveform.

SUMMARY OF THE INVENTION

An object of the present invention is to provide an electronic musical instrument which is adapted so that the compression of a harpsichord, percussive, or similar musical tone, provided in digital form, does not involve the generation of quantizing noise in its small amplitude portion.

To attain the above object, the electronic musical instrument of the present invention comprises means whereby when a digital signal waveform is compressed and stored, its amplitude is expanded in accordance with an envelope waveform to be appended later, and means for multiplying the expanded waveform data by the envelope waveform.

When the 16-bit quantized waveform of the percussive sound shown in FIG. 1A is compressed to, for instance, an 8-bit quantized waveform, quantizing noise will be generated in its small amplitude portion. According to the present invention, however, as shown in FIG. 1B, the amplitude of the compressed waveform is expanded to such an extent that no quantizing noise will be generated in its small amplitude portion, in accordance with the envelope waveform to be appended later, for instance, by multiplying the compressed waveform by a reciprocal of the corresponding amplitude of the envelope waveform. This eliminates the generation of quantizing noise even in the compression of a musical waveform to the 8-bit quantized form.

DESCRIPTION OF THE PREFERRED EMBODIMENTS

Figure 1A:
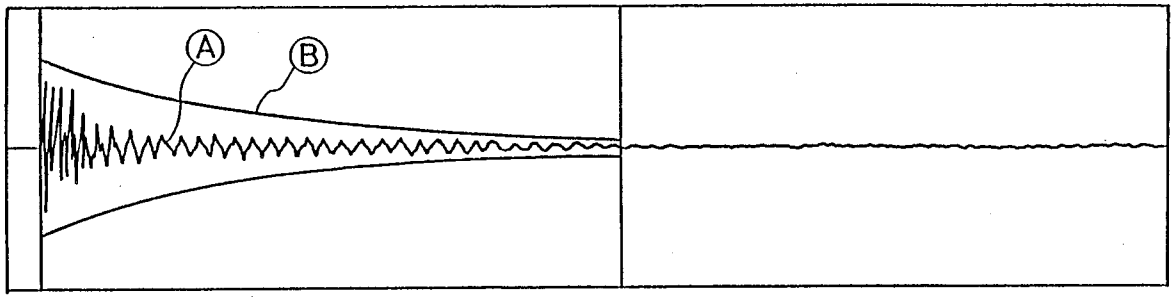
FIGS. 1A and 1B are diagrams showing the waveform of a percussive sound before and after amplitude expansion, respectively, the waveform of FIG. 1B being obtained by multiplying the waveform of FIG. 1A by the reciprocal of an envelope waveform shown in FIG. 1A.
Figure 1B:
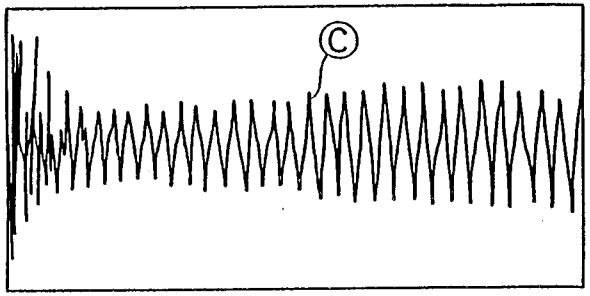
Figure 2:
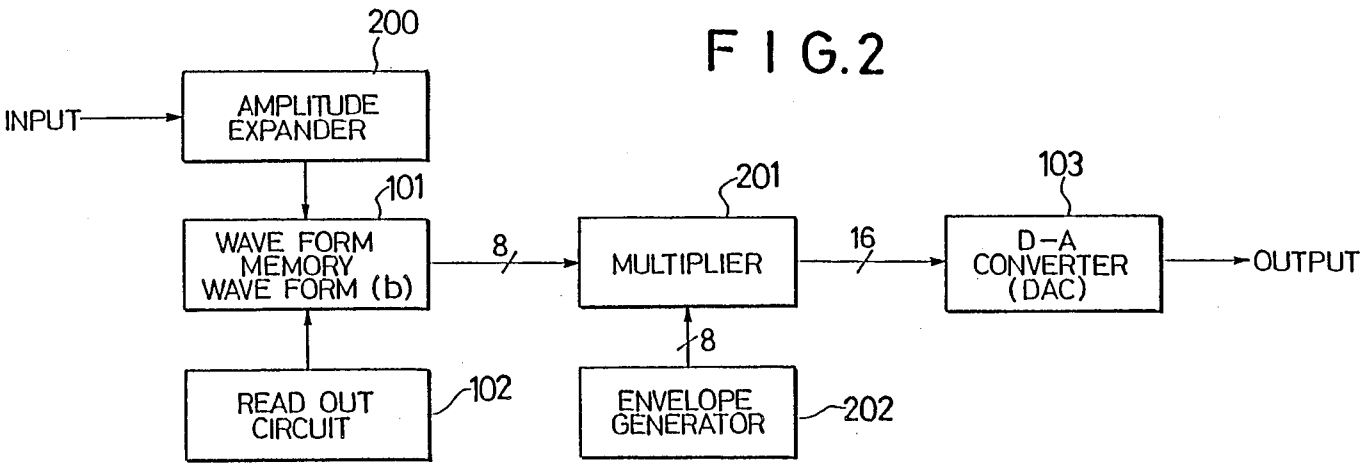
FIG. 2 is a block diagram illustrating an embodiment of the present invention.
Figure 3:
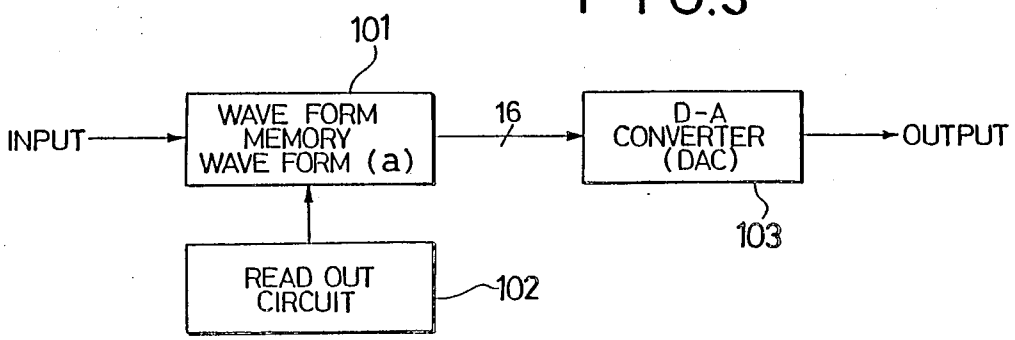
FIG. 3 is a block diagram showing a prior art example.

FIG. 2 illustrates in block form an embodiment of the present invention. In FIG. 2 a waveform quantized by 16 bits is compressed by an amplitude expander 200 to an 8-bit quantized waveform and, at the same time, it is multiplied by a reciprocal of an envelope value ((b) in FIG. 1A) to be appended later, thereby providing a waveform expanded in amplitude especially at the portion corresponding to a small amplitude portion of the original waveform. The amplitude-expanded waveform (c) in FIG. 1B is stored as the 8-bit quantized waveform in a waveform memory 101. The waveform read out of the waveform memory 101 by a readout circuit 102 is applied to a multiplier 201, wherein it is multiplied by an 8-bit envelope data available from an envelope generator 202. As a result of this, the envelope waveform shown in FIG. 1A is reproduced as 16-bit envelope data, which is converted by a D-A converter 103 into analog form.

As described above, according to the present invention, a waveform amplitude-expanded especially in its small amplitude portion as shown in FIG. 1B is stored in a memory, from which it is read out therefrom and is appended with an envelope, thereby reproducing the original waveform. This ensures the elimination of quantizing noise which is generated in a small amplitude portion of an 8-bit quantized waveform in the prior art. The present invention is of great utility when employed in the case where a percussive or similar musical tone provided in the form of a 16-bit quantized digital signal is compressed to an 8-bit quantized waveform.

It will be apparent that many modifications and variations may be effected without departing from the scope of the novel concepts of the present invention.

What is claimed is:

1. An electronic musical instrument in which a natural musical tone is converted into a digital signal and at least a section of the waveform of the digital signal is compressed to a quantized waveform, stored in a memory and read out therefrom for producing a musical tone, including;

means for storing data of the compressed waveform section in the memory, wherein said compressed waveform section has had its amplitude expanded in accordance with a predetermined envelope waveform; and, means for reading the stored amplitude-expanded digital waveform section data out of the memory and for digitally multiplying the digital waveform data read out by a digital envelope waveform, thereby reproducing the original waveform.

2. An electronic musical instrument according to claim 1, in which the multiplying means multiplies said section of the waveform by the reciprocal of the envelope value.

3. An electronic musical instrument according to claim 1, in which the whole waveform is compressed.

4. An electronic musical instrument in which a natural musical tone is converted into a digital signal for storage comprising:

a waveform envelope generator;

means for multiplying a quantized waveform of the tone by a reciprocal of the value of an envelope produced by the generator thereby expanding the amplitude of a portion of small amplitude of the original waveform;

means for compressing the multiplied quantized waveform thereby reducing the number of quantizing bits;

waveform memory means for storing the compressed amplitude expanded waveform;

waveform read out means for reading out the compressed waveform from the waveform memory means; and, means for multiplying the waveform that has been read out by the said envelope value to reproduce the original uncompressed waveform; and, a digital to analog converter for converting the waveform into analog form.

* * * * *